US009291029B2

(12) United States Patent
Løvslett et al.

(10) Patent No.: US 9,291,029 B2
(45) Date of Patent: Mar. 22, 2016

(54) ANCHOR MECHANISM FOR USE IN A WELL

(71) Applicant: ALTUS INTERVENTION AS, Stavanger (NO)

(72) Inventors: Robin Løvslett, Narvik (NO); Dag Ravn Pedersen, Narvik (NO)

(73) Assignee: Altus Intervention AS, Stavanger (NO)

( * ) Notice: Subject to any disclaimer, the term of this patent is extended or adjusted under 35 U.S.C. 154(b) by 0 days.

(21) Appl. No.: 14/395,005

(22) PCT Filed: Apr. 24, 2013

(86) PCT No.: PCT/NO2013/050071

§ 371 (c)(1),
(2) Date: Oct. 16, 2014

(87) PCT Pub. No.: WO2013/162380

PCT Pub. Date: Oct. 31, 2013

(65) Prior Publication Data

US 2015/0090441 A1 Apr. 2, 2015

Related U.S. Application Data

(60) Provisional application No. 61/640,494, filed on Apr. 30, 2012.

(30) Foreign Application Priority Data

Apr. 27, 2012 (NO) ..... 20120491

(51) Int. Cl.
*E21B 33/129* (2006.01)
*E21B 33/1295* (2006.01)

(52) U.S. Cl.
CPC ..... *E21B 33/1293* (2013.01); *E21B 33/129* (2013.01); *E21B 33/1295* (2013.01) 33/1292

(58) Field of Classification Search
CPC ..... E21B 33/129; E21B 33/1291; E21B ; E21B 33/1293; E21B 33/1295; E21B 33/12955
See application file for complete search history.

(56) References Cited

U.S. PATENT DOCUMENTS 2,313,178 A * 3/1943 Spang ..... E21B 33/129 166/123
3,456,723 A * 7/1969 Current ..... E21B 33/1292 166/120

(Continued)

FOREIGN PATENT DOCUMENTS

| | | |
|---|---|---|
| EP | 2128377 | 12/2009 |
| GB | 2402412 | 12/2004 |

*Primary Examiner* — Giovanna C Wright
(74) *Attorney, Agent, or Firm* — Gable Gotwals

(57) ABSTRACT

An anchor mechanism for use in a well including a housing with a plurality of openings evenly distributed along the circumference of the housing and each opening arranged to narrowly house a radially movably slip including first and second end portions, a gripping side facing a well wall, the gripping side being provided with a plurality of teeth, an underside facing the opposite direction, two side faces extending from the gripping side to the underside and to two end faces; the slip having, at its first and second end portions, with a first inclined face and a second inclined face substantially sloping from the end faces and towards the middle portion of the slip on the underside; the slip provided, on its end faces, with laterally projecting tongues having a longitudinal direction parallel to the inclined faces; the slip provided, on its two side faces, with guide portions exhibiting a longitudinal direction perpendicular to the longitudinal direction of the slip and the guide portion complementarily fitting an inward-facing guide in the housing; the anchor mechanism provided with first and second axially movable slip cones being surrounded in a portion of the housing; the slip cones having inclined faces in their position of application arranged to rest against the inclined faces of the slip, the slip cones provided with a plurality of grooves, each groove being arranged to house one tongue, and the housing being constituted by a first housing half and a second housing half.

5 Claims, 7 Drawing Sheets

(56) References Cited

U.S. PATENT DOCUMENTS 3,643,737 A * 2/1972 Current ..... E21B 33/1292 166/139
3,678,998 A * 7/1972 Cockrell ..... E21B 33/1293 166/123
4,359,090 A * 11/1982 Luke ..... E21B 33/1293 166/118
4,393,929 A * 7/1983 Akkerman ..... E21B 33/1295 166/120
4,437,517 A * 3/1984 Bianchi ..... E21B 33/1295 166/120
4,440,223 A 4/1984 Akkerman
6,241,017 B1 * 6/2001 Doane ..... E21B 23/01 166/134
2002/0121380 A1 9/2002 Doane et al.

* cited by examiner

ANCHOR MECHANISM FOR USE IN A WELL

CROSS-REFERENCE TO RELATED APPLICATIONS

This is the United States National Phase of PCT Application No. PCT/NO2013/050071 filed 24 Apr. 2013 which claims priority to Norwegian Patent Application No. 20120491 filed 27 Apr. 2012 which claims priority to U.S. Provisional Application No. 61/640,494 filed 30 Apr. 2012, each of which are incorporated herein by reference.

BACKGROUND OF THE INVENTION

The invention relates to an anchor mechanism for a tool which is temporarily to be fixedly positioned in a well. More particularly, the invention relates to an anchor mechanism which prevents sand and other material from entering the anchor mechanism while it is being used, and which allows the wedges of the anchor mechanism to be completely retracted when the anchor mechanism is being disengaged, even if sand and other material have entered the anchor mechanism.

Bridge plugs are installed in wells for hydrocarbon production that are under pressure. The purpose may be to seal a portion of the well, be a barrier that prevents the flow of hydrocarbons, or prevent the flow of gas, oil or water between zones downhole. Such a plug includes an anchor mechanism and a packer element, and the plug is normally set by means of an external setting tool which has been lowered into the well. The setting tool generates an axial force which is converted into a radial expansion of the anchor mechanism and the packer element so that the anchor mechanism and the packer element are pressing against the inner wall of the pipe. When the radial force of the packer element has reached a predefined level, the setting tool is disconnected from the plug and pulled out of the well. The plug remains fixed to the casing or the pipe downhole. The anchor mechanism holds the plug in place by frictional force between the wedges, the so-called slips, of the anchor mechanism and the inner pipe wall. When the axial force from the setting tool is converted into a radial force in the anchor mechanism, the slips are forced out against the inside of the pipe wall so that the entire plug is held in position in the axial direction.

A retrievable plug is normally retrieved from the well by lowering a pulling tool into the well. The pulling tool is attached to the so-called fishing neck of the plug; the plug is disengaged by the packer element and the slips of the anchor mechanism being retracted away from the inner wall of the pipe or the casing, and then the plug is pulled out of the well.

It is a known problem within the industry that there is a risk of retrievable plugs sticking when the plug is to be pulled out of the well, especially after periods during which the plug has been a barrier between zones of different pressures in the well. One problem is connected with sand and particles entering essential parts of the anchor mechanism and preventing movement in the mechanical systems. The anchor mechanism thereby does not function as intended when the plug is to be pulled.

Common embodiments of anchor mechanisms include slips that can be moved in two directions, in and out, in the radial direction of the plug. Such slips are much used to ensure that the correct clamping force against the inner wall of the pipe or casing is achieved. Many designs are based on the slips being provided, at their end portions, with inclined faces that are brought into contact with inclined faces on cooperating upper and lower slip cones, as shown in the patent document U.S. Pat. No. 4,359,090, for example. It is a problem with such slips that they must be held in a central position between the two cooperating slip cones. The slips must be held in position so that they can freely be moved radially. The patent document U.S. Pat. No. 4,359,090 teaches that this can be achieved by means of a plurality of axially elongated T-shaped brackets on the exterior of the plug. The ears of the brackets are in contact with grooves directed radially on the elongated, opposite axial side faces of the slip. The patent document U.S. Pat. No. 4,359,090 discloses an anchor mechanism which is open towards its surroundings so that particles may enter the mechanism and prevent the slips from being fully retracted in the radial direction when the plug is to be disengaged and pulled.

The patent document U.S. Pat. No. 4,436,150 discloses an alternative anchor mechanism, in which an upper, axially movable slip cone forces the slips radially outwards when the slip cone is being moved downwards. At its middle portion, each slip is provided with a spring which pulls the slip radially inwards as the slip cone is being moved upwards. This anchor mechanism is open towards its surroundings as well, so that particles may enter the mechanism and prevent the slips from being retracted completely in the radial direction when the plug is to be released and pulled.

The invention has for its object to remedy or reduce at least one of the drawbacks of the prior art or at least provide a useful alternative to the prior art.

The object is achieved through features which are specified in the description below and in the claims that follow.

The invention discloses an anchor mechanism for retrievable plugs for use in oil-producing and gas-producing petroleum wells. The anchor mechanism is arranged to prevent sand and other material from entering the mechanism. Sand and other material may prevent the slips of the anchor mechanism from being fully retracted when the plug is to be disengaged from the well wall and pulled out of the well. The anchor mechanism is arranged to be used in wells at high pressures, for example of 10,000 psi or 690 bars, and high temperatures, for example up to 200° C., and in wells with high concentrations of $H_2S$ and $CO_2$, for example 40% $H_2S$ and 20% $CO_2$. The choice of materials for forming such an anchor mechanism and such a plug must have regard to such conditions.

In a first aspect, the invention relates to an anchor mechanism for use in a well, the anchor mechanism including a housing with a plurality of openings; the openings being evenly distributed along the circumference of the housing and each opening being arranged to narrowly house a radially movably slip; the slip including first and second end portions, a gripping side facing a well wall, the gripping side being provided with a plurality of teeth, an underside facing the opposite direction, two side faces extending from the gripping side to the underside and to two end faces; the slip being provided, in its first and second end portions, with first and second inclined faces substantially sloping from the end faces towards the middle portion of the slip on the underside; the slip being provided, on its end faces, with laterally projecting tongues which have a longitudinal direction parallel to the inclined faces; the slip being provided, on its two side faces, with guide portions exhibiting a longitudinal direction perpendicular to the longitudinal portion of the slip and the guide portion complementarily fitting an inward-facing guide in the housing; the anchor mechanism is further provided with first and second axially movable slip cones, the slip cones being surrounded in a portion of the housing; the slip cones being provided with inclined faces which, in their position of application, are arranged to rest against the inclined faces of the slip, the slip cones further being provided with a plurality of grooves, each groove being arranged to house one tongue, and the housing being constituted by a first housing half and a second housing half. This has the advantage of simplifying the assembling of the anchor mechanism.

On its underside, the slip may be provided with a notch. This has the advantage of enabling foreign bodies, like sand and other material, having entered the mechanism while it has been in use in a well, to collect under the notch: The slip may be moved radially inwards until the teeth of the slip are flush with the surface of the housing, without the movement being obstructed by foreign bodies under the slip.

The tongue of the slip may be formed with a bevel on the side facing the inclined face of the slip cone. This has the advantage of the tongue not being subjected to shear forces directed radially, which could cause the tongue to break at the side face of the slip.

The housing halves may be provided with flanges projecting inwards, and the flanges may be stepped in a portion facing the opening, so that, after having been connected to each other, the housing halves may exhibit an inward-facing guide for the guide portion of the slip. Connecting the housing halves to each other at the flanges projecting inwards may be done with a bolt connection, a screw connection, by gluing or by welding. The inward-facing flanges may have the advantage of increasing the strength of the housing wall and of the guide getting great strength in the axial direction and sideways in the circumferential direction. The guide that may be formed by the flanges may simplify the assembling of the anchor mechanism by the guide not being formed as a separate component that has to be fixed separately to the wall of the housing. This may also reduce the number of components in the anchor mechanism. The guide may be a groove which complementarily fits a projecting ear on the side face of the slip so that the ear may form the guide portion of the slip. In an alternative embodiment, the guide may be a projecting lip which fits complementarily in a groove in the side face of the slip, so that the groove forms the guide portion of the slip. By an inward-facing guide is meant that the guiding direction is from the surface of the housing and in towards a central portion of the anchor mechanism.

The anchor mechanism may further include an inner sleeve positioned in the through openings of the slip cones; wherein the inner sleeve may be provided with an outer threaded portion on one end portion of the sleeve; and the sleeve may be threadedly fixed to an internal threaded portion of the first end portion of the first slip cone; and, on its inside, the sleeve may further be provided with a circular shoulder which may be arranged to rest against an external, circumferential shoulder on a mandrel which may extend internally through the sleeve. This has the advantage of the sleeve being usable for adjusting the axial distance between the slip cones and keeping it constant before the anchor mechanism is activated. The slips are thereby prevented from unintentionally being moved axially outwards. Such an unintentional movement could result in the teeth of the slips protruding beyond the surface of the housing. This could make insertion of the anchor mechanism into a conduit such as a pipe or casing, for example in a petroleum well, difficult.

In what follows, an example of a preferred embodiment is described, which is visualized in the accompanying drawings, in which.

Figure 1:
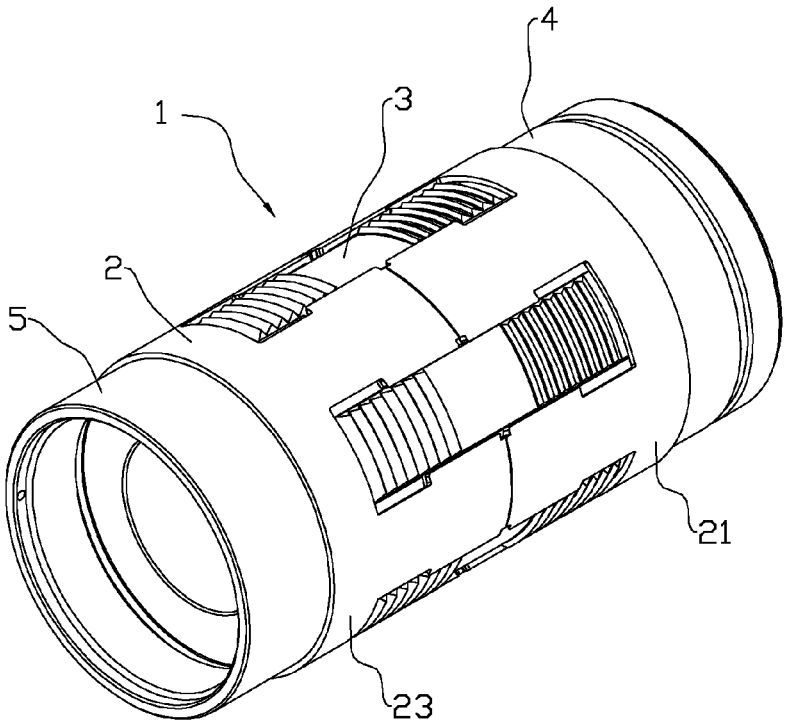
FIG. 1 shows an isometric perspective view of an anchor mechanism in accordance with the invention.
Figure 7A:
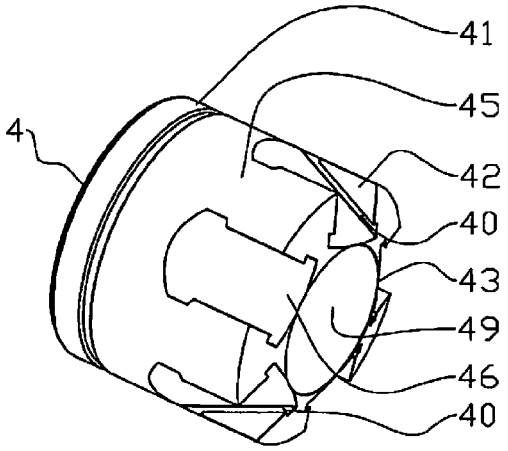
Figure 7B:
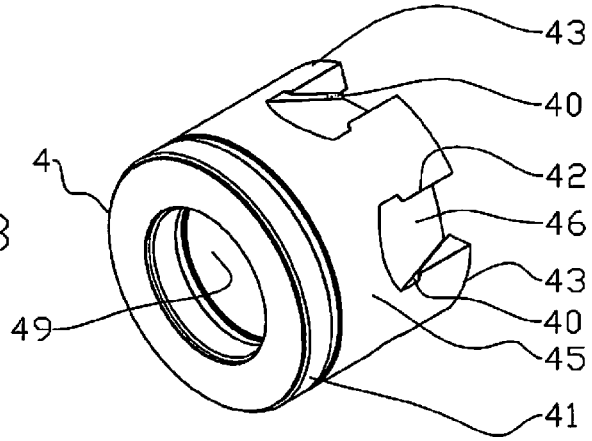
Figure 7C:
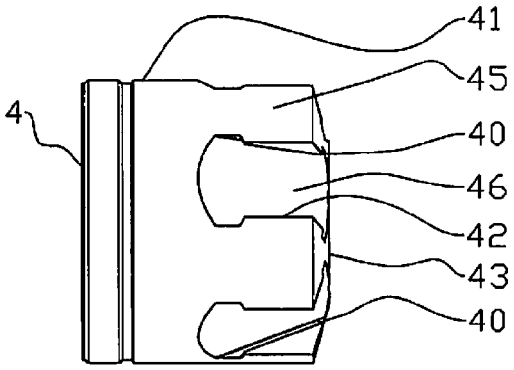
Figure 8:
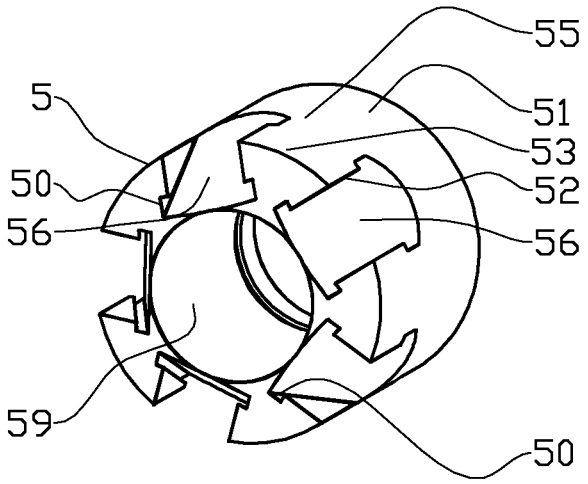
Figure 9:
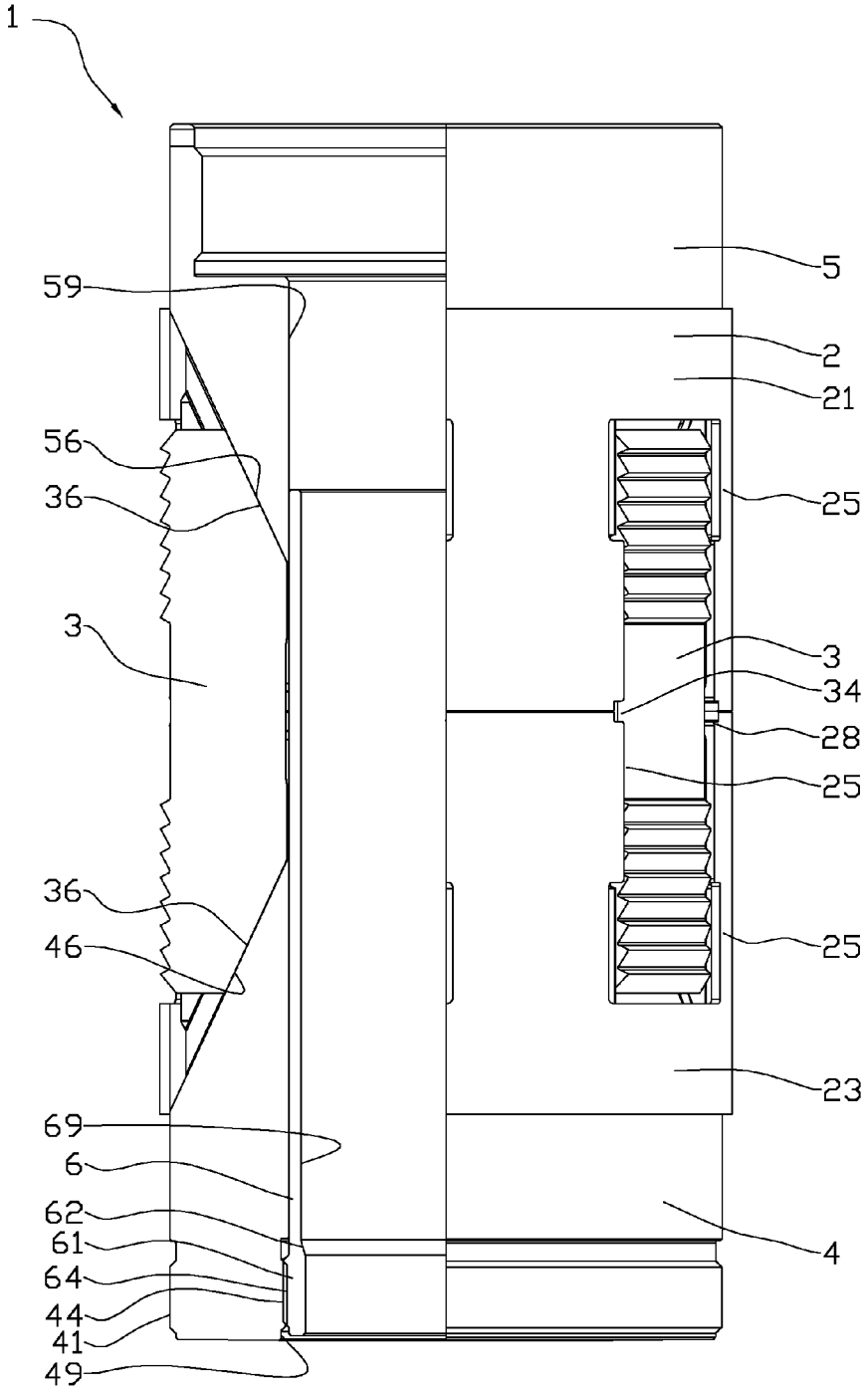

FIGS. 7A-C show, on a somewhat smaller scale than FIG. 1, isometric perspective views of a first slip cone from two sides, and a side view of the slip cone;

FIG. 8 shows, on the same scale as FIGS. 7A-C, an isometric perspective view of a second slip cone; and FIG. 9 shows, on a larger scale, to the left, a partial section and, to the right, a side view of the anchor mechanism.

In the drawings, the reference numeral 1 indicates an anchor mechanism in accordance with the invention. The anchor mechanism 1 includes a housing 2, a plurality of slips 3 and a first slip cone 4 and a second slip cone 5. The housing 2 includes a first housing half 21 and a second housing half 23 as shown in FIG. 1. In the position of application, the first slip cone 4 will be at the bottom and the second slip cone 5 will be at the top.

Figure 2:
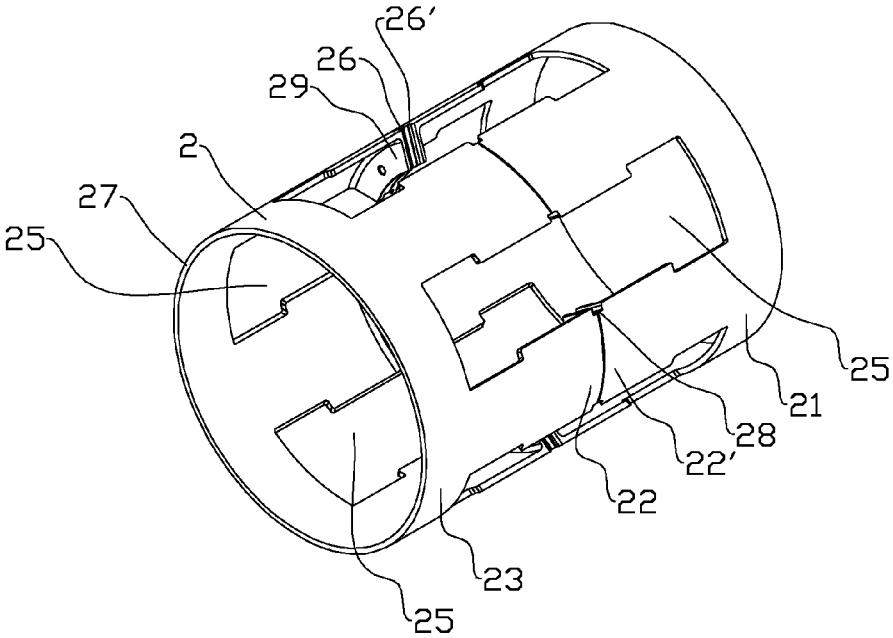
FIG. 2 shows, on the same scale as FIG. 1, an isometric perspective view of the housing of the anchor mechanism.
Figure 3:
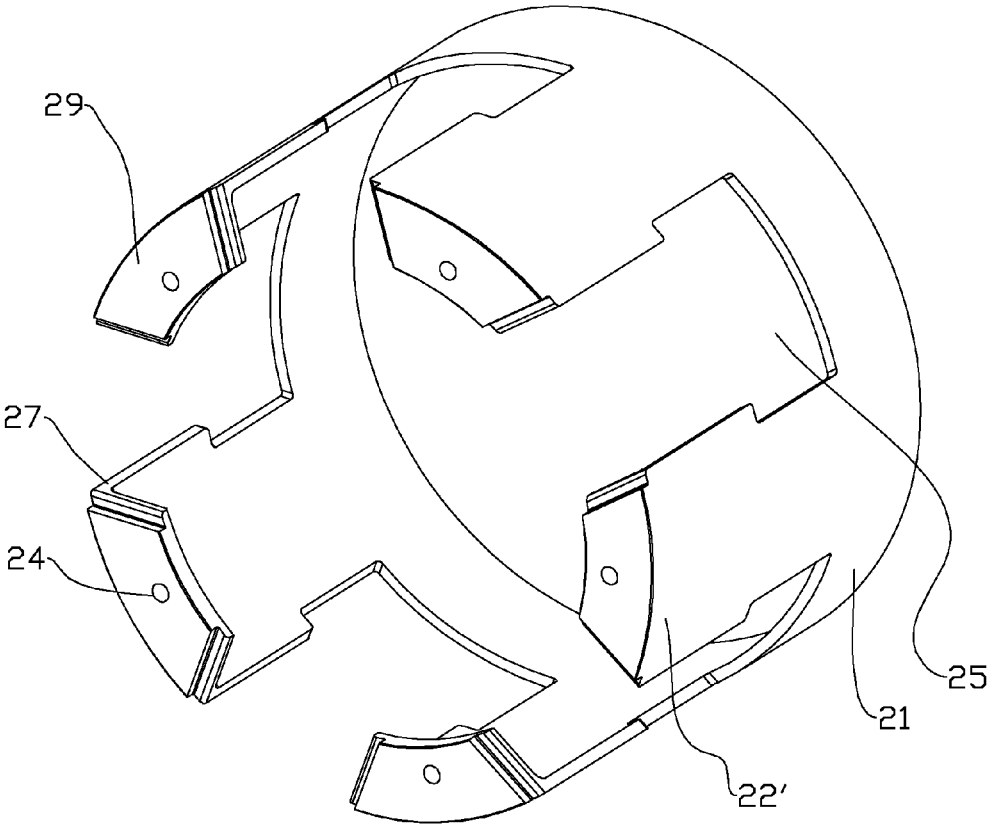
FIG. 3 shows, on a larger scale, an isometric perspective view of a housing half.

In FIG. 2, the housing 2 is shown with five through openings 25 in the wall 27 of the housing 2. The openings 25 are evenly distributed around the circumference of the housing 2. At their joining portions 22 and 22', respectively, the first housing half 21 and the second housing half 23 are provided with flanges 29 projecting inwards. The second housing half 23 is shown in greater detail in FIG. 3. The flange 29 is provided with a bore 24 so that a bolt connection or screw connection (not shown) may be formed between the first housing half 21 and the second housing half 23. At its portion facing the opening 25, the flange 29 is formed with a stepping 26 in the first housing half 21, as shown in FIG. 2, and a stepping 26' in the second housing half 23. The steppings 26, 26' form an inward-facing guide 28 which is shown as a groove 28, as shown in FIG. 2, for example.

Figure 4:
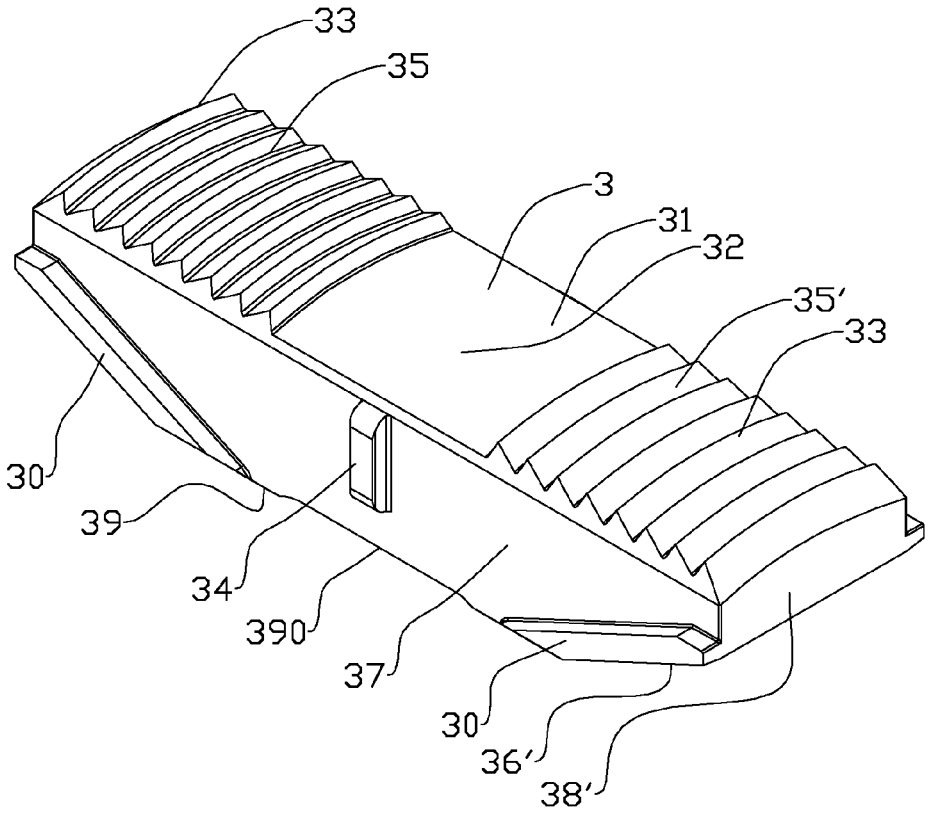
FIG. 4 shows, on a larger scale still, an isometric perspective view of the slip of the anchor mechanism.
Figure 5:
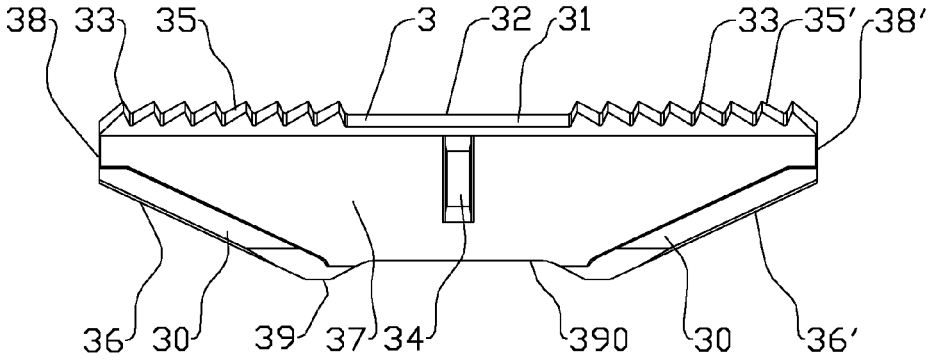
FIG. 5 shows, on a smaller scale than FIG. 4, a side view of the slip.
Figure 6:
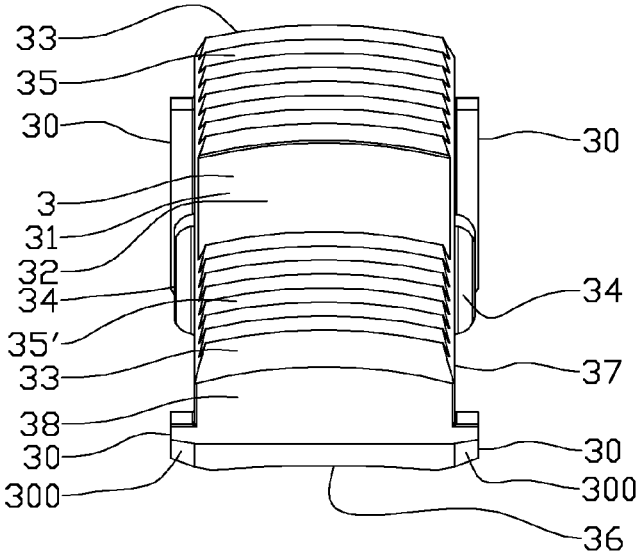
FIG. 6 shows, on the same scale as FIG. 4, a perspective view of the slip, viewed from the end portion of the slip.

One slip 3 is shown in greater detail in FIGS. 4-6. On its gripping side 31, the slip 3 is provided with a plurality of projecting serrations or teeth 33 in the first end portion 35 of the slip 3 and in the second end portion 35' of the slip 3. On the gripping side 31, between the teeth 33, there is a tooth-free portion 32. On its elongated, axial side face 37, the slip 3 is provided with a guide portion 34 which is shown in the form of a protruding ear 34 in the drawings. The ear 34 has a longitudinal axis perpendicular to the longitudinal axis of the slip 3. From the end face 38 of the slip 3, an inclined face 36 extends to the underside 39 of the slip 3. On its side face 37, the slip 3 is further provided with a tongue 30 projecting sideways. The longitudinal axis of the tongue 30 is parallel to the inclined face 36. The underside 39 of the slip 3 is provided with a notch 390 as shown in FIG. 5. The notch 390 extends between the inclined faces 36, 36' in the longitudinal direction of the slip 3 and between the side faces 37 in the width of the slip 3 so that the height of the slip 3 between the notch 390 and the tooth-free portion 32 is smaller than the height of the slip 3 at the portion in which the inclined faces 36, 36' meet the underside 39 of the slip 3 as shown in FIG. 5. The underside of the tongue 30 is provided with a bevel 300 in the entire projecting width and length of the tongue 30 as shown in FIG. 6. The bevel 300 may be formed with an angle of, for example, 15°.

The first slip cone 4 is shown in greater detail in FIGS. 7A-C. The slip cone 4 forms a first end portion 41 and a second end portion 43. From the outer jacket surface 45 of the slip cone 4 to the second end portion 43, a recess 42 is formed, forming a slanting face 46. The slip cone 4 is provided with a plurality of slanting faces 46. In the drawings, five slanting faces 46 are shown. Each recess 42 forms a further two grooves 40 which are parallel to the inclined face 46, on either side of the inclined face 46. A through opening 49 extends axially from the first end portion 41 to the second end portion 43. In the drawings, the first slip cone 4 is shown with a pointed second end portion 43 so that, in the axial direction, the slip cone 4 is longer at the through opening 49 than at the outer jacket surface 45, as shown in FIG. 7C. In an alternative embodiment, the end portion 43 of the slip cone 4 may be terminated perpendicularly to the longitudinal direction of the slip cone 4.

The second slip cone 5 is shown in greater detail in FIG. 8. The slip cone 5 forms a first end portion 51 and a second end portion 53. From the outer jacket surface 55 of the slip cone 5 to the second end portion 53, a recess 52 has been formed, forming a slanting face 56. The slip cone 5 is provided with a plurality of slanting faces 56. In the drawings, five slanting faces 56 are shown. Each recess 52 forms a further two grooves 50 which are parallel to the inclined face 56, on either side of the inclined face 56. A through opening 59 extends axially from the first end portion 51 to the second end portion 53. In the drawings, the second slip cone 5 is shown with a pointed second end portion 53 so that, in the axial direction, the slip cone 5 is longer at the through opening 59 than at the outer jacket surface 55. In an alternative embodiment, the end portion 53 of the slip cone 5 may be terminated perpendicularly to the longitudinal direction of the slip cone 5.

The structure and the operation of the anchor mechanism 1 are described with reference to FIG. 9. The housing 2 is formed by fixing the first housing half 21 and the second housing half 23 with bolts or screws (not shown) through the bores 24 in the flanges 29. The slips 3 are positioned with their inclined faces 36 on the inclined faces 56 of the second slip cone 5 so that the tongues 30 are inserted somewhat into the grooves 50. The slip cone 5 with the slips 3 is inserted into the housing 2. Then the first slip cone 4 is inserted into the housing from the opposite side and in such a way that the tongues 30 of the slips are inserted into the grooves 40 and in such a way that the inclined faces 36' rest against the inclined faces 46. The slip cones 4, 5 are moved further towards each other so that the slips 3 are moved outwards and so that the guide portions 34 of the slips, for example the ears 34, are moved into the guide 28, for example the groove 28, in the housing 2. The opening 25 has been formed with an outline matched to the outline of the slip 3, which is constituted by the side faces 37, end faces 38 and tongues 30. The slip 3 fits tightly but radially movably in the opening 25. The slip 3 is moved radially along the guide 28. The guide 28 and the guide portion 34 prevent the slip 30 from being axially movable relative to the housing 2. An inner sleeve 6 is positioned in the through opening 49, 59 of the slip cones 4, 5. At its one end portion 61, the sleeve is provided with an external threaded portion 64 which is screwed into an internal threaded portion 44 at the end portion 41 of the through opening of the slip cone 4. On its inside 69, at the end portion 61, the sleeve is provided with an internal circular shoulder 62.

After the anchor mechanism 1 has been assembled, the slip cones 4, 5 are both axially movable relative to the housing 2. The teeth 33 of the slips 3 will be flush with the surface of the housing 2. When the plug (not shown) is being assembled, a so-called mandrel (not shown) is passed through the sleeve 6. On its surface, the mandrel is provided with a shoulder which will rest against the shoulder 62. The second slip cone 5 is fixedly connected to the packer mechanism (not shown) of the plug. Upon assembly, but before the plug is completely set in a well, the mandrel and the second slip cone 5 will be immovable relative to each other in an axial direction. By rotation of the sleeve 6, the first slip cone 4 will be moved axially away from the second slip cone 5 because of the threaded portions 44 and 64 and the shoulder 62. In this way, the anchor mechanism 1 may be tightened and slackened and the slip cones 4, 5 held fixed at a fixed distance. Thereby, the slips 3 cannot unintentionally be moved axially so that the teeth 33 will project beyond the surface of the housing 2 before the plug is being set.

When the plug is being set, a downward axial force is applied to the second slip cone 5 and the slip cones 4, 5 are moved axially towards each other. The axial movement of the slip cone 5 relative to the slip 3 at the inclined face 56, gives the slip 3 an outward radial movement because of the inclined face 36' of the slip 3, towards the inner wall (not shown) of a surrounding pipe or casing. The housing 2 is axially movable relative to the slip cone 4 and the slip cone 5, and the guide 28 and guide portion 34 hold the slip 3 axially centred relative to the slip cones 4 and 5. Thereby the slip 3 will not be pinched between the slip cones 4 and 5. The axial movement of the slip 3 relative to the slip cone 4 at the inclined face 46 gives the slip 3 an outward radial movement because of the inclined face 36 of the slip 3.

The bevel 300 of the tongue 30 results in there being no radial force from the inclined faces 46, 56 on the tongue 30. This has the advantage of no shear forces arising on the tongue 30 which could make it break at the transition to the side wall 37.

The tongue 30 slides in the groove 40, 50. When the plug is being released, the mandrel is moved downwards within the plug by means of gravity or by the mandrel being extended. This results in the slip cone 4 being moved axially downwards. The movement is transmitted to the slip 3 at the slanting grooves 40 cooperating with the tongues 30. The slip 3 is moved radially inwards and axially downwards, transmitting the axial downward movement to the housing 2. The movement of the tongue 30 in the slanting groove 50 also makes the slip 3 be moved radially inwards.

Sand and other material that have possibly entered the anchor mechanism 1 while the anchor mechanism 1 has been operative in the well will collect in a portion between the underside 39 of the slip 3, the end portions 41, 51 of the slip cones 4, 5 and the outer surface of the inner sleeve 6. The notch 390 ensures that the slip 3 may be moved farther radially inwards towards the inner sleeve 6 as sand and other material may collect in the notch 390. It is thereby ensured that the slip 3 may be moved in all the way, so that the teeth 33 are flush with the outer side of the housing 2 when the plug is being disengaged and pulled out of the well.

The tooth-free portion 32 of the slip 3 results in the middle portion of the slip 3 not taking any forces as the slip 3 is tightened against the pipe wall. The clamping forces directed radially are transmitted via the inclined faces 36, 36' of the slip 3 to the inclined faces 46, 56 of the slip cone 4, 5. The slip cones 4, 5 thereby support the slip 3 in the portions that are subjected to pressure, which prevents the slip 3 from being subjected to a bending moment which may break the slip 3 at its middle portion.

While the invention has been described with a certain degree of particularity, many changes may be made in the details of construction and the arrangement of components without departing from the spirit and scope of this disclosure. It is understood that the invention is not limited to the embodiments set forth herein for purposes of exemplification, but is limited only by the scope of the attached claims, including the full range of equivalency to which each element thereof is entitled.

The invention claimed is:

1. An anchor mechanism for use in a well, the anchor mechanism comprising:

a housing with a plurality of openings;

the openings being evenly distributed along the circumference of the housing and each opening being arranged to narrowly house a radially movable slip;

the slip including first and second end portions, a gripping side facing a well wall, the gripping side being provided with a plurality of teeth, an underside facing the opposite direction, two side faces extending from the gripping side to the underside and to two end faces; the slip being provided, at first and second end portions, with a first inclined face and a second inclined face substantially sloping from the end faces towards the middle portion of the slip on the underside; the slip being provided, on its end faces, with laterally projecting tongues which have a longitudinal direction parallel to the inclined faces; the slip being provided, on two side faces, with guide portions exhibiting a longitudinal direction perpendicular to the longitudinal direction of the slip and the guide portions complementarily fitting an inward-facing guide in the housing; and the anchor mechanism further being provided with first and second axially movable slip cones, the slip cones being surrounded in a portion of the housing; the slip cones being provided with inclined faces which, in their position of application, are arranged to rest against the inclined faces of the slip, the slip cones further being provided with a plurality of grooves, each groove being arranged to house one tongue, wherein the housing is constituted by a first housing half and a second housing half.

2. The anchor mechanism in accordance with claim 1, wherein, on the underside, the slip is provided with a notch.

3. The anchor mechanism in accordance with claim 1, wherein the tongues are formed with a bevel on a side facing the inclined face of the slip cone.

4. The anchor mechanism in accordance with claim 1, wherein the housing halves are provided with flanges projecting inwards, the flanges being stepped in a portion facing the opening, so that after having been connected to each other, the housing halves exhibit an inward-facing guide for the guide portion of the slip.

5. The anchor mechanism in accordance with claim 1, wherein the anchor mechanism further includes an inner sleeve positioned in through openings of the slip cones; wherein an inner sleeve is provided with an outer threaded portion on one end portion of the sleeve; and the sleeve is threadedly attached to an internal threaded portion at a first end portion of the first slip cone; and wherein, on an inside, the sleeve is further provided with a circular shoulder arranged to rest against an external, circumferential shoulder on a mandrel extending internally through the sleeve.

* * * * *